United States Patent [19]

Hunter

[11] Patent Number: 4,471,908

[45] Date of Patent: Sep. 18, 1984

[54] PATTERN SPRINKLER HEAD

[75] Inventor: Edwin J. Hunter, Rancho Santa Fe, Calif.

[73] Assignee: The Toro Company, San Marcos, Calif.

[21] Appl. No.: 469,027

[22] Filed: Feb. 23, 1983

Related U.S. Application Data

[63] Continuation of Ser. No. 241,625, Mar. 9, 1981, abandoned.

[51] Int. Cl.[3] ..... B05B 1/02; B05B 1/26; B05B 3/04; B05B 15/04

[52] U.S. Cl. ..... 239/11; 239/97; 239/205; 239/206; 239/601; 239/DIG. 1

[58] Field of Search ..... 239/1, 11, 97, 203–206, 239/231, 237, 240, 598, 601, DIG. 1

[56] References Cited

U.S. PATENT DOCUMENTS

| | | |
|---|---|---|
| 1,308,613 | 7/1919 | Anderson . |
| 1,335,267 | 3/1920 | Ambrose . |
| 1,618,538 | 2/1927 | Kittinger . |
| 1,766,514 | 6/1930 | Henry . |
| 2,002,178 | 5/1935 | Henry . |
| 2,047,348 | 7/1936 | Wilson . |
| 2,414,052 | 1/1947 | Martin . |
| 2,595,114 | 4/1952 | Wieseltier . |
| 2,600,987 | 6/1952 | Gallice . |
| 2,601,559 | 6/1952 | Riblet . |
| 2,619,388 | 11/1952 | Wahlin . |
| 2,634,163 | 4/1953 | Double . |
| 2,723,157 | 11/1955 | Thompson . |
| 2,739,839 | 3/1956 | Greener et al. . |
| 2,999,643 | 9/1961 | Kennedy . |
| 3,026,044 | 3/1962 | Kennedy . |
| 3,035,777 | 5/1962 | Bodell et al. . |
| 3,095,148 | 6/1963 | Smith . |
| 3,104,818 | 9/1963 | Ballard et al. . |
| 3,111,268 | 11/1963 | Butler . |
| 3,131,867 | 5/1964 | Miller et al. . |
| 3,391,868 | 7/1968 | Cooney . |
| 3,424,381 | 1/1969 | Best . |
| 3,428,256 | 2/1969 | Painter . |
| 3,580,506 | 5/1971 | Costa . |
| 3,854,664 | 12/1974 | Hunter . |
| 3,884,416 | 5/1975 | King . |
| 4,019,686 | 4/1977 | Palma . |
| 4,119,275 | 10/1978 | Hunter . |
| 4,272,024 | 8/1979 | Kah, Jr. . |
| 4,281,793 | 8/1981 | DeWitt . |

*Primary Examiner*—Andres Kashnikow

*Attorney, Agent, or Firm*—Poms, Smith, Lande & Rose

[57] ABSTRACT

An improved sprinkler of the type adapted to rotate and create a redefined horizontal spray pattern around it. A rotating turbine drives a cylindrical nozzle assembly having a plurality of nozzle openings therein. The nozzle openings deliver streams of water of variable length and volume. A pattern defining disk is used to continuously and proportionately expose the nozzle openings to the source of pressurized water according to a preset function of the instantaneous rotational position of the nozzle opening as the cylindrical member turns to create the spray pattern. The nozzle openings supply a relatively constant volume of water to all portions of the pattern.

8 Claims, 5 Drawing Figures

PATTERN SPRINKLER HEAD

This is a continuation of application Ser. No. 241,625, filed Mar. 9, 1981, now abandoned.

FIELD OF THE INVENTION

The present invention relates to irrigation sprinkler heads of the rotary type, and, more particularly, to sprinkler heads dispersing water at a constant precipitation rate according to a preselected pattern.

BACKGROUND OF THE INVENTION

Turbine driven pop-up sprinkler heads of the type shown in my U.S. Pat. No. 2,909,325 provided a step increase in the art of irrigation. Previously, rotary sprinklers were of the impact driven type wherein a high velocity stream of water deflected a spring-loaded hammer which nudged the sprinkler in a rotary direction about a vertical pin-axis upon its return. Whereas such impact driven sprinklers emitted a high precipitation rate water stream in order to effect the necessary forces to cause rotation, the pop-up type sprinklers of my aforementioned patent employed a small water turbine wheel rotating at relatively high speed to effect slow rotation of a sprinkler nozzle turret on top. Accordingly, the emitted stream or streams of water from one or more nozzle openings in the rotating turret could be such as to effect a low precipitation rate of water dispersal to maximize water penetration to the desired area while minimizing undesired water runoff.

In my later issued U.S. Pat. No. 3,854,664, I disclosed improvements to such turbine driven sprinklers. In particular, a bulkhead was disposed between the common source of water under pressure and the plurality of nozzle openings contained in a rotating turret. Each of the nozzles terminated in an opening wiping over the surface of the bulkhead as the turret turned. By providing openings in the bulkhead, the pathways to the nozzles were selectively opened and shut as a function of the direction in which the particular is instantaneously facing. In this manner, a preestablished on/off spray pattern was put into the sprinkler head. However, the preestablished pattern was limited to circular arcs.

In pattern sprinklers, a rectangular shape is very often desirable, as most garden and landscape areas are on rectangular lots surrounding rectangular buildings. Known sprinkler heads creating a rectangular spray pattern are of the fixed and oscillating type. The fixed type, having a plurality of holes in the top, generally does not distribute water evenly over the entire area and tends to be of a high precipitation rate type. The oscillating type is large and is generally not suited to the permanent irrigation systems, but rather to connection to the end of a garden-type hose for selective placement within an area to be watered on a time-by-time basis.

Furthermore, in those prior art sprinklers capable of watering a preestablished pattern, the size of the pattern is changed by an increasing or decreasing the pressure of the water supplied to the sprinkler. By doubling the pressure, the area coverable by the prior art sprinklers increases by approximately four times. However, the gallonage discharged by the sprinkler nozzles only increases by a factor of 1.41 (the square root of 2). Accordingly, the precipitation rate is greatly reduced when the prior art sprinklers are used to cover a larger area by increasing the pressure of the water supplied to the sprinklers.

Accordingly, it is the primary object of the present invention to discharge water from a sprinkler head over a preselected pattern at a constant precipitation rate.

SUMMARY OF THE INVENTION

The present invention, in a broad aspect, provides a sprinkler head connected to a source of pressurized water and having at least one nozzle which is revolved about a vertical axis by the flow of water between the connection to the water source and the nozzle to create a horizontal watering pattern from the water emitted from the nozzle. A nozzle opening delivers a stream of water of variable volume and length from the nozzle. The nozzle opening is continuously and proportionately exposed to the source of pressurized water according to a preset function of the nozzle's instantaneous rotational position as the nozzle turns. Accordingly, the sprinkler head creates a horizontal spray pattern of preset configuration and supplies a relatively constant volume of water to all portions of the pattern.

In accordance with one feature of the invention, the sprinkler can also include provisions on the nozzle to downwardly deflect the water stream from the nozzle to provide more water to the area of the spray pattern closer to the sprinkler head.

In accordance with another feature of the invention, the nozzle opening can be shaped as a radial "V" cut from a plane parallel to the vertical axis of rotation of the nozzle to a plane normal to the axis, relative to a point exterior of the nozzle. The "V" shape of the opening emits a stream of water whose length increases linearly with the exposed length of the opening to the pressurized water and whose volume increases as the square of the exposed length of the opening. A constant precipation rate is thereby maintained as the volume of water dispersed from the nozzle increases as the square of the distance of water must travel. The radial shape of the opening directs the stream of water passing therethrough in a generally horizontal direction.

In accordance with a further feature of the invention, the sprinkler head can comprise a generally cylindrical member endwise exposed to the source of pressurized water. The cylindrical member can contain a plurality of nozzles, each with the aforementioned radial "V" shape.

In accordance with a further feature of the invention, the nozzle openings are exposed to the source of pressurized water by a bulkhead positioned between the openings and the water. The bulkhead has an opening defining the spray pattern to be produced. As the nozzles are rotated, the bulkhead individually varies the amount of each opening exposed at the source of water in proportion to the distance the nozzles must propel the streams instantaneously in the spray pattern. The nozzle openings provide a volume of water to the spray pattern proportional to the amount of the openings exposed to the source of water.

In accordance with a final feature of the invention, the deflection of the water from the nozzles can be accomplished with a toothed helical ring vertically adjustable across the nozzle openings. As the ring is moved vertically downward, the nozzle stream is deflected in a nonuniform manner to direct portions of the stream from the nozzle closer to the sprinkler head.

Other objects, features, and advantages of the foregoing invention will become apparent from a consideration of the following detailed description and the accompanying drawings.

DETAILED DESCRIPTION

Figure 1:
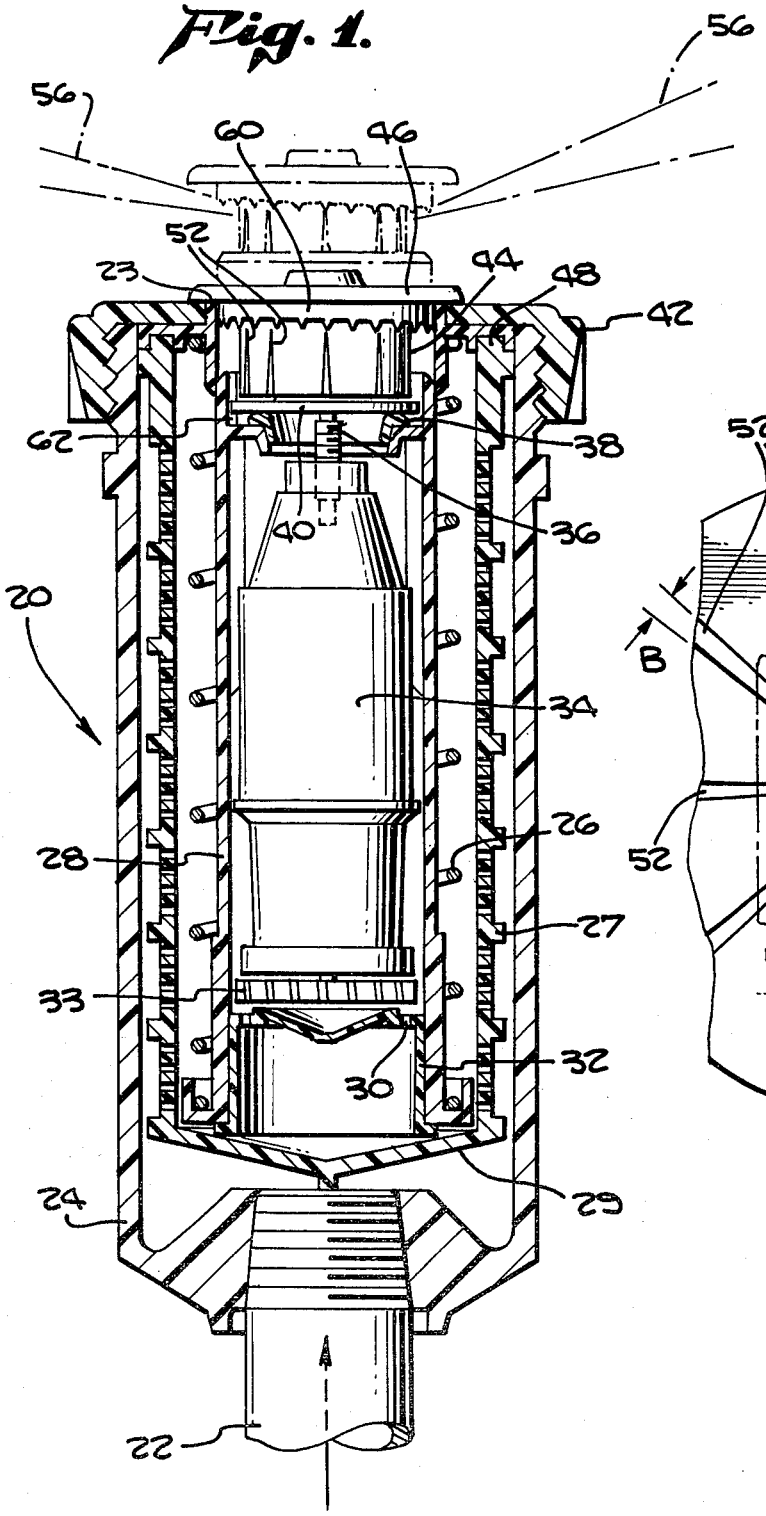
FIG. 1 shows an elevational view of a pop-up sprinkler according to the present invention.

Referring more particularly to the drawings, FIG. 1 shows an elevational view of a pop-up type sprinkler assembly, generally denoted 20. The specific improvement to a sprinkler of the present invention in its operating portion is primarily embodied in the pop-up type sprinkler assembly 20. A detailed description of such general assemblies can be seen in my aforementioned prior U.S. Pat. No. 3,854,664. For purposes of the present invention, assembly 20 will be described only briefly. Inlet pipe 22 from a source of pressurized water leads into a closed sprinkler body 24. The body 24 has a cap 42 with a circular opening 23 in the top thereof through which a cylindrical member 28 is disposed capable of sliding vertically up and down through the circular opening 23. Cylindrical member 28 is biased in a downward direction by biasing spring 26 and by gravity. When pressurized water is introduced to the sprinkler body 24, cylindrical member 28 is forced upwardly through the circular opening 23 against the force of gravity and the biasing spring 26. When water pressure is turned off, cylindrical member 28 retracts once again into the body 24 through the circular opening 23. A cylindrical screen member 27 is disposed around cylindrical member 28 and has small openings to allow water to pass through but to prevent the passage into the operating sprinkler mechanism of particles sufficiently large as to foul the operating mechanism.

Disposed within cylindrical member 28 and moving in combination therewith is a turbine-gear motor drive, generally denoted 34. The bottom of cylindrical member 28 contains a stator 32 having a hole 30 through which water can pass and impinge upon an impeller 33 of the turbine-gear motor drive 34. As the impeller 33 is rotated by the water passing thorugh the hole 30, a plurality of gears (not shown) attached thereto cause upper shaft 36 to be rotated slowly. Upper shaft 36 is attached to a generally cylindrical nozzle assembly 44 according to the present invention, causing it to rotate. The nozzle assembly 44 rotates within a ring member 48 disposed beneath the upper portion of the sprinkler body 24. The ring member 48 also engages the closing spring 26 and the screen 27 to maintain them in proper position within the sprinkler 20. Water passing around the turbine-gear motor drive 34 enters the nozzle assembly 44 and exits through the nozzle openings 52 to create emitted sprinkling water streams 56 as the nozzle assembly 44 rotates. The specific improvements of the present invention as incorporated within the known basic pop-up sprinkler mechanism will now be described.

From basic hydrodynamics, it is known that fluid pressure and distance are directly proportional, whereas flow rate (and corresponding volume) are in a square relationship to pressure. Thus, as the pressure of a stream of water is doubled, the volume of water in the stream only increases by the square root of two (1.41). The only means of adjusting the sprinklers of the prior art to cover a larger area is to increase the pressure to the sprinkler head. Accordingly, if the pressure to a prior art sprinkler is doubled, the sprinkler head would throw water twice the distance. The amount of water from the sprinkler head, however, would only increase by 1.41. The result is that larger patterns can only be watered at a lower preciptiation rate than smaller patterns with the prior art sprinklers.

As mentioned, the other problem with the prior art sprinklers is that the only type of spray patterns coverable are rectangular spray patterns. The prior art sprinklers are not capable of covering a nonrectangular spray pattern of arbitrary shape.

Figure 5:
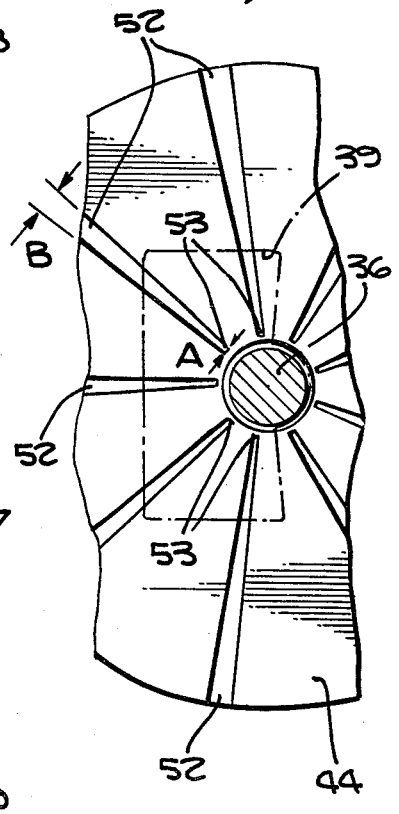
FIG. 5 shows a detailed cross-sectional view of the exposure of the nozzle opening to the water within the sprinkler of FIG. 1 via the pattern bulkhead disposed therein.
Figure 3:
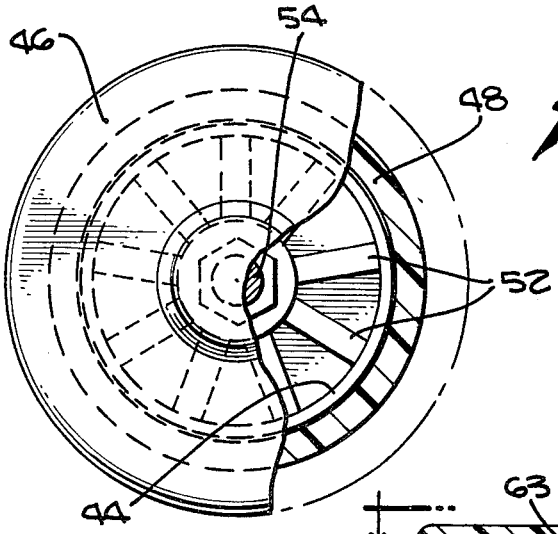
FIG. 3 shows a sectional view of the nozzle of FIG. 2, taken through the plane III—III.
Figure 2:
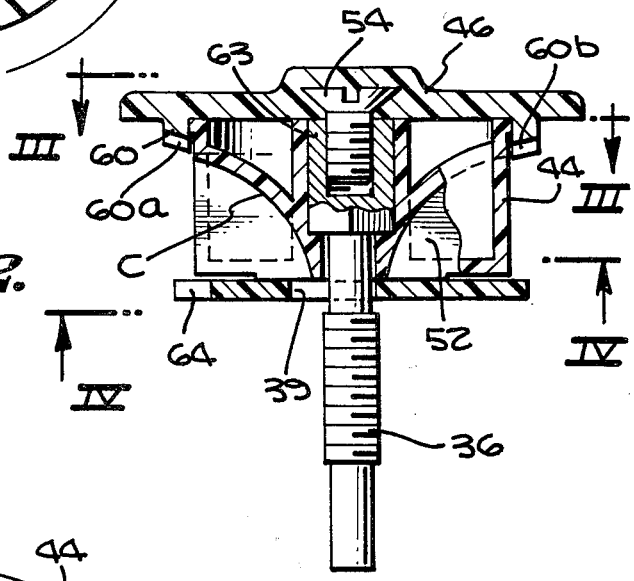
FIG. 2 shows a cross-sectional view of the nozzle portion of the sprinkler shown in FIG. 1.
Figure 4:
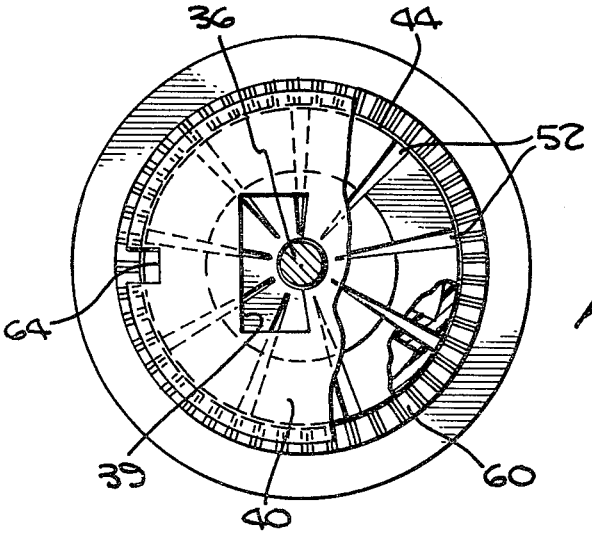
FIG. 4 shows a sectional view of the nozzle of FIG. 2, taken through the plane IV—IV.

The present invention overcomes all of these limitations. Specifically, the nozzle assembly 44 is provided with a plurality of nozzle openings 52, as shown in more detail in FIGS. 2–5. As shown in FIG. 2, each of the openings 52 is shaped in cross-section to have a radial shape relative to a point exterior of the nozzle assembly 44. As shown in FIGS. 4 and 5, each of the nozzle openings 52 appears as a "V" shape relative to a plane normal to the axis of rotation. The nozzle assembly of the present invention produces a tight, well-knit plurality of streams due to the true arc curve of the nozzle opening 52.

As shown in FIG. 2, the nozzle assembly 44 is a generally cyldindrical element having a plurality of the nozzle openings 52. Attached to the nozzle assembly 44, via a screw 54 engaging a threaded opening 63 in the nozzle assembly 44, is a top cap 46. The top cap 46 limits the downward travel of the nozzle assembly 44 within the sprinkler body 24 under the force of gravity and the closing spring 26. The cap 46 also has an integral helical toothed ring 60, as will be described hereinafter.

The nozzle assembly 44 can be a molded plastic part. The one-piece molding of the present invention is to be contrasted with the nozzles of the prior art sprinklers which were two-part assemblies welded together.

Disposed beneath the nozzle assembly 44 is a bulkhead 40 having a spray pattern opening 39 therein, as shown in FIG. 5. The bulkhead 40 is fixedly mounted for nonrotation in the sprinkler body 20 by means of a slot 64 on the bulkhead 40 which engages a boss 62 extending outwardly from the inner housing 28. The bulkhead 40 rests upon a resilient sealing ring 38, which insures that all water passing from within the sprinkler body 20 to the environment through the nozzle assembly 44 passes through the pattern opening 39 in the bulkhead 40.

The bulkhead 40 is preferrably of smooth, corrosion-resistant, wear-resistant metal such as stainless steel. High strength, wear-resistant, graphite filled plastic has also been tried with some success. In operation, the spray pattern 39 in the bulkhead 40 directs the water from within the sprinkler body 20 through the nozzle openings 52 as the length of the nozzle openings 52 is instantaneously and continuously varied by the bulkhead 40.

With reference to FIG. 5, one can easily envision how the exposed length of the nozzle openings 52 are changed as the nozzle assembly 44 rotates relative to the bulkhead 40. Referring to FIG. 5, it is seen that the exposed length of the nozzle opening 52 in the 9:00 o'clock position is significantly less than the exposed length of the nozzle opening 52 in the 10:00 o'clock position. That is, the effective opening of each of the nozzles 52 is continuously varied as the nozzle assembly 44 rotates relative to the bulkhead 40. As a result, each of the nozzle openings 52 will vary the projected distance of their associated water streams proportionately to the length of the exposed nozzle openings. Most importantly, the V-shape of each of the nozzle openings (in a plane normal to the shaft 36) provides a volume of water which increases as the square of the length of an exposure of the nozzle opening 52 via the bulkhead 40. That is, with reference to FIG. 5, as the exposed length of the nozzle opening 52 in the 10:00 o'clock position is approximately twice the length of the exposed nozzle opening 52 in the 9:00 o'clock position, the nozzle opening 52 in the 10:00 o'clock position will project a stream twice as far as the nozzle opening 52 in the 9:00 o'clock position and with four times the volume.

Accordingly, each nozzle emits a stream whose distance increases linearly with the length of the exposed nozzle opening 52 and whose volume increases as the square of the exposed length of the nozzle opening 52. Therefore, the limitation of the prior art sprinklers in covering greater distances only by increasing the pressure, which effected a corresponding decrease in the volume metric flow rate has been overcome. The design of the nozzle assembly 44 and the bulkhead 40 provides variable length streams of water at a constant volumetric flow rate, thereby achieving a relatively uniform precipitation rate over the entire pattern to be watered. As should be obvious from the foregoing, the spray pattern achievable with the present invention can have any configuration employing straight or curved boundaries, or any combination thereof. A rectangular spray pattern has been shown with the present invention only to make easier the explanation of its operation.

The foregoing demonstrates the simplicity of the present invention and its effectiveness in not only in generating streams having a distance of throw directly proportional to the exposure of the nozzle opening to the water within the sprinkler body 24, but also in delivering the correct volume of water to each sector of the spray pattern.

It should be noted that an increase or decrease in the precipitation rate produced by the nozzle assembly 44 can be effected by changing the number of nozzle openings 52 in the cylindrical assembly 44. Prototypes of the invention have been made using 6, 9, 12 or 18 nozzle openings 52 to change the precipitation rate over the pattern to be covered. It has been found that 6 openings with 6 pounds of pressure will produce a uniform precipitation rate over a pattern which is 5 feet by 10 feet, while 18 openings with 30 pounds of pressure produces an even precipitation rate over a pattern of 25 feet by 55 feet. The precipitation rate is said to be constant insofar as a 1.5 to 1 ratio of precipitation between the farther and closer areas of the pattern is maintained. Accordingly, the number of nozzles and the pressure of the water supply is selected according to the particular size of the pattern to be covered.

While the number of nozzle openings 52 may be changed to vary the precipitation rate produced by the nozzle assembly 52, it has been found that an optimum shape for each nozzle opening is as follows, with reference to FIG. 5. Dimension A is optimally on the order of 0.015 inches, and dimension B is optimally 8 degrees. The radius of curvature of the curved portion of the nozzle, (dimension C) in FIG. 2 is approximately 0.6 inches.

As noted above, different pressures and different nozzle openings are used depending upon the size of the pattern to be covered. For correct operation of the present invention, water at a relatively constant pressure must be supplied to the sprinkler body. In this regard, the inlet pipe 22 is preferrably connected to a pressure regulator to insure a uniform pressure. An internal pressure regulator may also be used with the invention.

The operation of the present invention is enhanced by the inclusion of a generally helical toothed ring 60 attached to the top cap 46 on the nozzle assembly 44. This toothed ring, as shown in FIGS. 1, 2, and 4, is used to deflect water from the nozzle openings 52 to an area closer to the sprinkler 20. The top cap 46 is rotatable relative to the nozzle assembly 44 by way of the screw 54 in the boss 63 formed within the nozzle assembly 44. By rotating the top cap 46 downwardly, more of the teeth on the ring 60 are brought into contact with the emitted streams 56 to deflect them closer to the sprinkler 20.

The toothed ring finds application with large spray patterns and with corresponding high pressures in the sprinkler body to propel the streams to cover the patterns. If the pressure is reduced to achieve a smaller pattern or area of coverage, most of the water tends to fall in the outer perimeter of the pattern. Accordingly, by adjusting the helical toothed ring 60 downwardly, the teeth on the helical ring 60 progressively encounters more of the emitted streams and deflects these streams to reduce the distance of throw. Thus, an increasing number of the streams can be pulled in to correct the distribution pattern that exists at low pressures. The toothed adjustment ring 60 is adjusted downward if there is not enough water close to the sprinkler 20 and is adjusted upward if there is too much water close to the sprinkler 20. As shown in cross-section in FIG. 2, the helical nature of the ring is achieved by having smaller teeth **60*a* and larger teeth 60*b*** on the ring.

The combination of the novel design of the nozzle assembly 44 and the bulkhead 40 when combined with the helical toothed ring 60 achieves relatively uniform watering over a wide variety of spray patterns.

In the foregoing description of the present invention, a preferred embodiment of the invention has been disclosed. It is to be understood that other mechanical and design variations are within the scope of the present invention. Accordingly, the invention is not limited to the particular arrangement which has been illustrated and described in detail herein.

What is claimed is:

1. In an irrigation sprinkler head adapted for connecting to a source of pressurized water and having at least one nozzle which is revolved about a vertical axis by the flow of water between the connection to the water source and the nozzle to create a horizontal watering pattern from the water emitted from the nozzle, nozzle opening means for delivering a stream of water of variable volume and distance from said nozzle and means for continuously and proportionately exposing said opening means to said source of said pressurized water according to a present function of said nozzle's instantaneous rotation position as said sprinkler turns, whereby said sprinkler head will create a horizontal spray pattern of preset configuration and will supply a relatively constant volume of water to all portions of said pattern, the improvement wherein said nozzle opening means comprising:

an opening for said nozzle shaped as a radial "V" cut from a plane parallel to said vertical axis of rotation to a plane normal to said axis and relative to a point exterior of said nozzle, with said V-shape of said opening emitting a stream of water whose distance increases linearly with the exposed length of said opening means to said source of pressurized water and whose volume increases as the square of exposed length to supply a volume of water through said opening which increases as the square of distance of said opening from said axis and with the radial shape of said opening directing said stream in a generally horizontal direction.

2. The irrigation sprinkler head of claim 1, wherein said sprinkler head further comprises:

a plurality of nozzles, each having the aforesaid radial "V" cut opening, whereby as said plurality of nozzles are rotated, said exposing means individually varies the amount of said opening means exposed to said source of water in direct proportion to the distance said nozzles must propel their streams instantaneously in said spray pattern, with said opening means providing a volume of water to said spray pattern proportional to said amount of said opening means exposed to said source of water.

3. The irrigation sprinkler head of claim 2, wherein:

each of said nozzles with the aforesaid nozzle opening comprises said radial "V" cut in a cylindrical member endwise communicating with said source of water.

4. In an irrigation sprinkler head connected to a source of pressurized water and rotating about a vertical axis to create a horizontal spray pattern, the method of evenly watering the spray pattern at radial distances from the sprinkler head at a relatively constant precipitatin rate comprising the steps of:

providing the sprinkler head with at least one nozzle opening having a shape to deliver a stream of water of variable length and volume when pointed in a given direction and provided with a source of water at a relatively constant pressure from within said sprinkler head;

providing said sprinkler head with a bulkhead disposed between said nozzle opening and said source of water;

providing an opening in said bulkhead defining the spray pattern to be produced;

rotating said nozzle opening across said spray pattern opening to thereby vary the exposed area of said nozzle opening in direct proportion to the distance said opening must propel its stream instantaneously in said spray pattern; and as the sprinkler head rotates, exposing said nozzle opening to said constant pressure water source by an amount proportional to the distance of said spray pattern from said sprinkler head, whereby exposing more of said nozzle opening supplies a greater volume of water from said nozzle over a longer distance an at a uniform flow rate opening to effect delivery of a stream of water over said spray pattern at a uniform precipitation rate, wherein the improvement in said method includes the additional steps of:

providing said sprinkler head with a plurality of nozzle openings, with each of said openings having a radial shape relative to a point away from said sprinkler head and in a plane parallel with said vertical axis of rotation, and having a wedge shape in a plane normal to said axis of rotation, with said radial shape directing said nozzle stream in a generally horizontal direction and with said wedge shape allowing a greater volume of water to flow through said nozzle opening as more of said opening is exposed to said water supply by said bulkhead; and rotating all of said nozzle openings across said supply pattern opening to thereby individually vary the exposed areas of said openings in proportion to the distance said openings must propel their streams instantaneously in said spray pattern, with said shape of each nozzle providing a volume of water to said spray pattern proportional to the exposed area of said nozzle opening.

5. In an irrigation sprinkler head adapted for connecting to a source of pressurized water and having at least one nozzle which is revolved about a vertical axis by the flow of water between the connection to the water source and the nozzle to create a horizontal watering pattern with the water emitted from the nozzle, the improvement comprising:

an opening for said nozzle shaped as a radial "V" cut from a plane parallel to said vertical axis of rotation to a plane normal to said axis of rotation and relative to a point exterior of said nozzle to provide a water stream of variable volume and length from said sprinkler head to said water pattern.

6. The irrigation sprinkler head of claim 5, wherein said sprinkler head additionally comprises:

means for continuously and proportionately controlling said opening as said nozzle turns according to a preset function of the nozzle's instantaneous rotational position whereby the sprinkler head will create a horizontal spray pattern of a preset configuration.

7. The irrigation sprinkler head of claim 6 wherein said controlling means cromprises:

a bulkhead fixedly disposed between said nozzle opening and said source of pressurized water and having an opening defining a spray pattern to be produced, whereby as said nozzle is rotated, said nozzle opening is moved across said bulkhead opening, said bulkhead opening varying the area of said nozzle opening exposed to said water source in proportion to the distance said nozzle must propel its stream to cover said pattern, and with said nozzle opening shape providing a volume of water to said spray pattern directly proportional to said exposed area of said nozzle opening.

8. An irrigation nozzle apparatus adapted for exposure to a source of pressurized water and emitting a horizontal spray pattern, comprising:

a nozzle body with at least one nozzle opening emitting a confined stream of water, said opening being shaped as a radial "V" cut from a plane parallel to a vertical axis through said body to a plane normal to said axis and relative to a point exterior of said nozzle, with said opening emitting a stream of water whose distance increases linearly with the exposure of said opening to said source of pressurized water and whose volume increases as the square of said exposure to supply a volume of water through said opening which increases as the square of distance of said opening from said axis and with the radial shape of said opening directing said stream in a generally horizontal direction.

* * * * *